US010622113B2

(12) United States Patent
Hayakawa et al.

(10) Patent No.: US 10,622,113 B2
(45) Date of Patent: Apr. 14, 2020

(54) RADIATION SHIELDING SHEET

(71) Applicants: TOPPAN PRINTING CO., LTD., Tokyo (JP); TOMOEGAWA CO., LTD., Tokyo (JP)

(72) Inventors: Masaru Hayakawa, Tokyo (JP); Minoru Tsuchida, Shizuoka (JP)

(73) Assignees: TOPPAN PRINTING CO., LTD., Tokyo (JP); TOMOEGAWA CO., LTD., Tokyo (JP)

( * ) Notice: Subject to any disclaimer, the term of this patent is extended or adjusted under 35 U.S.C. 154(b) by 716 days.

(21) Appl. No.: 14/461,567

(22) Filed: Aug. 18, 2014

(65) Prior Publication Data

US 2016/0322122 A1 Nov. 3, 2016

Related U.S. Application Data

(63) Continuation of application No. PCT/JP2013/054707, filed on Feb. 25, 2013.

(30) Foreign Application Priority Data

Feb. 23, 2012 (JP) ..... 2012-037694

(51) Int. Cl.
*G21F 1/08* (2006.01)
*G21F 3/02* (2006.01)
(Continued)

(52) U.S. Cl.
CPC ..... *G21F 1/08* (2013.01); *A41D 13/043* (2013.01); *D04H 3/015* (2013.01); *D04H 3/10* (2013.01); *D04H 3/153* (2013.01); *D06M 11/83* (2013.01); *D21H 11/04* (2013.01); *D21H 17/67* (2013.01); *D21H 21/18* (2013.01); *D21H 21/20* (2013.01);
(Continued)

(58) Field of Classification Search
CPC ... G21F 1/08; G21F 1/125; G21F 1/10; G21F 1/106; G21F 3/02; D21H 21/18; D21H 21/20; D21H 11/04; D21H 17/67; D04H 3/10; D04H 3/153; D04H 3/015; D06M 2101/06; D06M 2200/25; D06M 11/83; A41D 13/043; A41D 31/0011; B32B 2264/105; B32B 23/00–22; B32B 2262/062; B32B 2262/065;
(Continued)

(56) References Cited

U.S. PATENT DOCUMENTS

2003/0102463 A1* 6/2003 Smith ..... G21F 1/106 252/500
2004/0004196 A1 1/2004 DeMeo et al.
2006/0124871 A1 6/2006 Ballsieper

FOREIGN PATENT DOCUMENTS

CA 2 440 402 A1 9/2002
JP 53-139807 12/1978
(Continued)

OTHER PUBLICATIONS

Mortensen, A., "Concise Encyclopedia of Composite Materials", 2nd Ed., Elsevier, pp. 563-573 (Year: 2007).*
(Continued)

*Primary Examiner* — Andrew T Piziali

(57) ABSTRACT

A radiation shielding sheet of the present invention includes a fiber and a granular radiation shielding material, in which the fiber and the radiation shielding material are integrally formed into the shape of a sheet.

6 Claims, 4 Drawing Sheets

(51) Int. Cl.

| | |
|---|---|
| ***G21F 1/12*** | (2006.01) |
| ***G21F 3/00*** | (2006.01) |
| ***G21F 1/10*** | (2006.01) |
| ***A41D 13/04*** | (2006.01) |
| ***D04H 3/015*** | (2012.01) |
| ***D04H 3/10*** | (2012.01) |
| ***D04H 3/153*** | (2012.01) |
| ***D06M 11/83*** | (2006.01) |
| ***D21H 11/04*** | (2006.01) |
| ***D21H 17/67*** | (2006.01) |
| ***D21H 21/18*** | (2006.01) |
| ***D21H 21/20*** | (2006.01) |
| *A41D 31/04* | (2019.01) |
| *D06M 101/06* | (2006.01) |

(52) U.S. Cl.
CPC ..... *G21F 1/10* (2013.01); *G21F 1/106* (2013.01); *G21F 1/125* (2013.01); *G21F 3/00* (2013.01); *G21F 3/02* (2013.01); *A41D 31/04* (2019.02); *D06M 2101/06* (2013.01); *D06M 2200/25* (2013.01); *D10B 2501/00* (2013.01)

(58) Field of Classification Search
CPC .... B32B 2262/067; D10B 2201/00–30; D10B 2501/00
USPC ..... 428/533–537.7; 442/380, 412, 413
See application file for complete search history.

(56) References Cited

FOREIGN PATENT DOCUMENTS

| | | | |
|---|---|---|---|
| JP | 60-190898 | | 9/1985 |
| JP | 08179090 | A | 7/1996 |
| JP | 2000-328483 | | 11/2000 |
| JP | 2002-55194 | | 2/2002 |
| JP | 3098317 | | 2/2004 |
| JP | 2004-523759 | | 8/2004 |
| JP | 2005-147667 | | 6/2005 |
| JP | 2005-538356 | | 12/2005 |
| JP | 2006-9197 | | 1/2006 |
| JP | 2006-526434 | | 11/2006 |
| JP | 2008-175811 | | 7/2008 |
| JP | 2009-262553 | | 11/2009 |
| JP | 3167330 | | 4/2011 |
| JP | 3172240 | | 12/2011 |
| JP | 2012-503694 | A | 2/2012 |
| JP | 2013-61279 | | 4/2013 |
| KR | 10-2005-0072742 | | 7/2005 |
| WO | WO 02/073627 | A1 | 9/2002 |
| WO | WO 2004/021811 | A2 | 3/2004 |
| WO | WO 2007/038238 | A2 | 4/2007 |

OTHER PUBLICATIONS

European Office Action dated Aug. 18, 2016 in corresponding European Patent Application No. 13752307.2.
Extended European Search Report dated Sep. 18, 2015 in corresponding European Patent Application No. 13752307.2.
International Search Report dated May 14, 2013, in corresponding International Patent Application No. PCT/JP2013/054707.
Japanese Office Action dated May 10, 2016 in corresponding Japanese Patent Application No. 2012-037694.
Office Action dated Feb. 6, 2018, in corresponding Japanese Patent Application No. 2017-055119, 6 pgs.
Korean Office Action dated Jan. 18, 2019 in Korean Patent Application No. 10-2014-7023229 (4 pages) (3 pages English Translation).
Korean Office Action dated Jul. 23, 2019 in Korean Patent Application No. 10-2014-7023229 (4 pages) (3 pages English Translation).
Notice for Reasons for Rejection dated Aug. 20, 2019 in related Japanese Patent Application No. 2017-055119 (3 pages) (3 pages English Translation).

* cited by examiner

FIG. 3

| SOURCE | MAIN ENERGY | HALF LIFE | UNSHIELDED | LEAD 1mm | EXAMPLE 1 TEN-LAYER LAMINATED | EXAMPLE 2 TEN-LAYER LAMINATED | LEAD 0.5mm |
|---|---|---|---|---|---|---|---|
| I-123 | 159(83.8%) | 13.27 HOURS | 0.27μsv/h | 44% | 22% | 19% | 19% |
| Tc-99m | 141(89.1%) | 6.01 HOURS | 0.27μsv/h | 63% | 30% | 30% | 26% |
| Tl-201 | 71-80(94%) | 72.91 HOURS | 0.27μsv/h | 67% | 37% | 37% | 30% |
| F-18 | 511 | 109.8 MINUTES | 0.27μsv/h | 4% | 7% | 0% | 4% |

RADIATION SHIELDING SHEET

CROSS REFERENCE TO RELATED APPLICATIONS

This application is a continuation application based on a PCT Patent Application No. PCT/JP2013/054707, filed Feb. 25, 2013, whose priority is claimed on Japanese Patent Application No. 2012-037694 filed on Feb. 23, 2012, the content of which is hereby incorporated by reference.

BACKGROUND OF THE INVENTION

Field of the Invention

The present invention relates to a radiation shielding sheet, specifically, a radiation shielding sheet having excellent folding performance and workability.

Description of Related Art

Conventionally, a radiation shielding material has been used to suppress radiation exposure to equipment, clothing, structures, moving bodies, and the like, which are used in the fields of medicine, nuclear energy, space technology, and other such fields (for example, refer to Patent Document 1 (Published Japanese Translation No. 2006-526434 of the PCT International Publication)). In addition, protective clothing, such as an apron or a skirt, using a radiation shielding material, has been used to suppress radiation exposure for doctors engaged in radiography or the like at a medical site.

As the radiation shielding material, lead is frequently used. Even as for the aforementioned protective clothing, protective clothing in which thin lead plates are arranged is generally used.

However, lead is highly toxic and is not easy to handle at the time of disposal or the like. When lead is used in protective clothing, a problem arises in that the movement of a user is hindered due to the heaviness of lead. Further, folding performance and workability are not sufficient and when the lead plate is applied to a solid object or a human body, and an opening is easily generated. Therefore, the lead plate is not sufficient for the purpose of suppressing radiation exposure which is the original purpose in some cases.

SUMMARY OF THE INVENTION

The present invention has been made in consideration of the above circumstances, and an object thereof is to provide a radiation shielding sheet having excellent workability and handling properties.

According to an aspect of the present invention, a radiation shielding sheet is provided including a fiber, and a granular radiation shielding material, in which the fiber and the granular radiation shielding material are integrally formed into the shape of a sheet.

According to the aspect of the present invention, it is preferable that the content of the radiation shielding material be 0.25 or more by weight ratio with respect to 1 by weight of the fiber.

In addition, according to the aspect of the present invention, it is preferable that an average particle size of the radiation shielding material be 1 to 100 micrometers.

According to the aspect of the present invention, it is preferable that the radiation shielding material be a metal, and an oxide of the metal, or a metal salt of the metal.

In addition, according to the aspect of the present invention, it is preferable that the metal include at least one of barium, iron, and tungsten.

Since the radiation shielding sheet according to the aspect of the present invention has excellent workability and handling properties, the radiation shielding sheet can be suitably used in a wide range of applications and thus, radiation exposure can be suitably suppressed.

BRIEF DESCRIPTION OF THE DRAWINGS

FIG. 3 is a table showing a γ-ray shielding capacity of the radiation shielding sheet.

DETAILED DESCRIPTION OF THE INVENTION

An embodiment of the present invention will be described with reference to FIGS. 1 to 4C.

Figure 1:
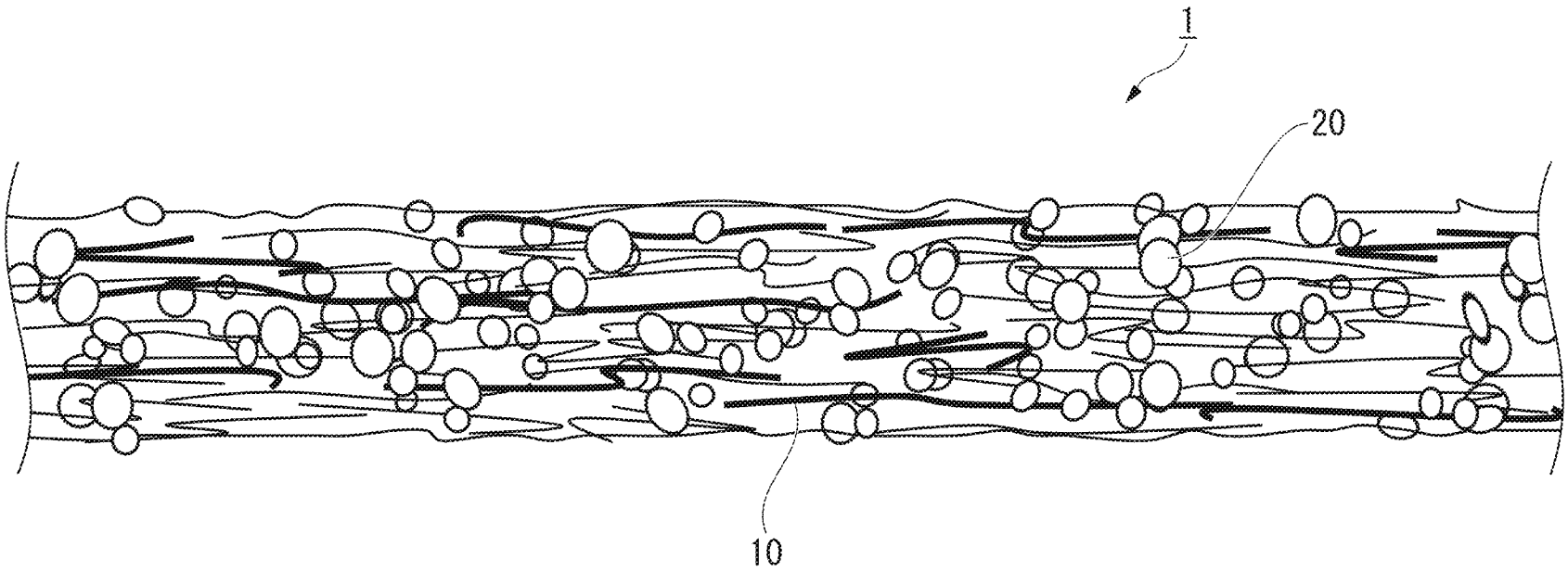
FIG. 1 is a schematic cross-sectional view of a radiation shielding sheet according to an embodiment of the present invention.

FIG. 1 is a cross-sectional view showing a radiation shielding sheet 1 of the embodiment. The radiation shielding sheet 1 includes a fiber 10, and a granular radiation shielding material 20, and the fiber 10 and the radiation shielding material 20 are integrally formed in a sheet shape.

For example, as the fiber 10, mechanical pulp such as ground wood pulp (GP), pressurized ground wood pulp (PGW), and thermo-mechanical pulp (TMP), chemical pulp such as high yield needle-leaved tree kraft pulp (HNKP; Nadelholz), needle-leaved tree bleached kraft pulp (NBKP; Nadelholz, Nadelholz Bleichte), broad-leaved tree unbleached kraft pulp (LUKP; Laubholz), and broad-leaved tree bleached kraft pulp (LBKP; Laubholz), waste paper pulp such as deinked pulp (DIP), and waste pulp (WP), and wood pulp such as semi-chemical pulp (CP) can be used. In addition, as natural fibers other than wood, pulp fibers such as cotton, straw, bamboo, esparto, bagasse, linter, manila hemp, flax, hemp, jute, and Gampi can be used and one or two or more can be appropriately selected from these fibers to be used. Particularly, needle-leaved tree bleached kraft pulp (NBKP; Nadelholz, Nadelholz Bleichte) is preferable since the fiber length is long and the sheet strength is increased.

Further, the aforementioned various fibers are used as main fibers, and as auxiliary fibers, one or more appropriately selected from organic polymer fibers such as rayon, acetate, triacetate, nylon 6, nylon 66, vinylon, vinylidene, polyvinyl chloride, polyester, acryl, polyethylene, polypropylene, polyurethane, aramid, and polyvinyl alcohol, inorganic fibers such as glass fibers, carbon fibers, activated carbon fibers, alumina fibers, and rock wool fibers, and metal fibers such as stainless, and the like can be mixed and used.

For example, when there is an attempt to improve the strength and water resistance of the radiation shielding sheet 1, organic polymer fibers exhibiting a heat fusion function at 90° C. to 250° C. are suitably used. The aforementioned heat fusion refers to an adhesion function by melting or softening.

As organic polymer fibers used in this case, for example, there are heat-fusible fibers which are organic polymer fibers having a two-layer structure of a core and a sheath, and have a core-sheath structure having a configuration such as composite fibers such as PP (polypropylene)/PP, PP/PE (polyethylene), and PET (polyethylene terephthalate)/PET having a low melting point, PET fibers having a low melting point, or PP fibers, or a single component structure.

The fineness of the auxiliary fibers mixed with the main fibers to be used is preferably 0.5 to 20 decitex (dtex), and more preferably 1 to 5 dtex. When the fibers are excessively fine, the strength is insufficient. On the other hand, when the fibers are excessively thick, the fiber strength is increased. However, when the fibers are excessively thick, the number of fibers per unit weight is decreased, and as a result, the heat fusion part is decreased and thereby causes the insufficient strength. Further, the fiber length of the auxiliary fibers is preferably approximately 1 to 15 mm, and more preferably approximately 3 to 7 mm. When the fiber length is excessively short, the strength is insufficient and when the fiber length is excessively long, papermaking (making paper) is difficult. In addition, the amount of the auxiliary fibers mixed is preferably 1 percent by weight (wt %) to 50 percent by weight, and more preferably approximately 3 to 30 wt % with respect to a total amount of the main fibers. When the amount of the auxiliary fibers blended is excessively small, the strength is insufficient. On the other hand, when the amount of the auxiliary fibers blended is excessively large, an inflexible and hard sheet is obtained and thus, the folding performance and the workability are deteriorated.

As the radiation shielding material 20, for example, one or two or more of granular compounds composed of barium, iron, and tungsten, oxides thereof, and metal salts thereof can be mixed and used. Regarding barium, barium sulfate is particularly preferable in terms of being chemically stable and having high stability. In addition to the above materials, heavy metals having a specific gravity of 5 or more, and compounds of the heavy metals having a specific gravity of 5 or more can be used singly or in a mixture.

When the radiation shielding sheet of the present invention is produced by a wet papermaking method or a dry papermaking method, the diameter of the granular radiation shielding material is preferably 1 micrometer (μm) or more and 100 μm or less, and more preferably 1 μm to 30 μm. When the diameter of the granular radiation shielding material is less than 1 μm, falling occurs in a papermaking wire during papermaking, and the yield is significantly reduced. Thus, it is difficult to obtain a radiation shielding sheet in which a desired amount of the radiation shielding material is contained. On the other hand, when the diameter of the granular radiation shielding material is more than 100 μm, cohesiveness is deteriorated and the fiber 10 cannot hold the radiation shielding material 20 with a sufficient strength, and thus, there is a concern that the radiation shielding material may be separated from the radiation shielding sheet after drying.

A method for producing the radiation shielding sheet of the present invention is not particularly limited, and the radiation shielding sheet 1 can be produced by blending the aforementioned fiber 10 and the radiation shielding material 20 at a predetermined ratio and integrally forming the blended material in a sheet shape, using, for example, a wet papermaking method or a dry papermaking method.

When the radiation shielding sheet 1 is produced by a wet papermaking method, the blended material is dispersed in water to prepare slurry and the obtained slurry is formed into paper using a wet papermaking machine (papermaking step). The fiber 10 as the main fiber is preferably subjected to beating in advance. The beating can be appropriately performed by a beating machine such as a single disc refiner (SDR), a double disc refiner (DDR), or a beater. The degree of beating is preferably approximately 750 CSF to 100 CSF, and more preferably approximately 500 CSF to 150 CSF in terms of Canadian standard freeness (CSF: JISP 8121).

In the papermaking step, a flocculant can be appropriately used. The flocculant is not particularly limited and various anionic flocculants, nonionic flocculants, cationic flocculants, or amphoteric flocculants can be used. For example, organic compounds such as polyacrylamide-based cationic resin, nonionic resin, anionic resin and amphoteric resin, polyethyleneimine and derivatives of the polyethyleneimine, polyethylene oxide, polyamines, polyamides, polyamidepolyamine and derivatives of the polyamidepolyamine, cationic starch and amphoteric starch, oxidized starch, carboxymethylated starch, vegetable gum, polyvinyl alcohol, urea-formalin resin, melamine-formalin resin, and hydrophilic polymer particles, and inorganic compounds including aluminum compounds such as aluminum sulfate, alumina sol, basic aluminum sulfate, basic aluminum chloride, and basic polyaluminum hydroxide, and iron(II) sulfate, iron(II) chloride, colloidal silica, bentonite or the like can be used.

In the papermaking step, addition of the flocculant, and the amount of the flocculant added are arbitrary. However, when the flocculant is added, the addition amount is preferably 0.001 wt % or more, and more preferably 0.005 wt % or more with respect to a solid content in the water dispersion. When the addition amount is less than 0.001 wt %, there is a concern that aggregation effect may not be obtained.

In addition, in the papermaking step, papermaking chemicals such as a sizing agent, a wet paper strengthening agent, or filler can be appropriately used, as required.

The sizing agent is not particularly limited and examples thereof include various sizing agents such as a rosin sizing agent for acid papermaking, a petroleum resin sizing agent, an alkyl ketene dimer sizing agent for neutral papermaking, and an alkenyl succinic anhydride sizing agent.

Examples of the wet paper strengthening agent include melamine resin, urea resin, polyamide epichlorohydrin resin, epoxy resin, dialdehyde starch, polyacrylamide, and polyethyleneimine.

Examples of the filler include mineral fillers such as talc, kaolin, calcined kaolin, clay, diatom earth, heavy calcium carbonate, magnesium carbonate, aluminium hydroxide, titan dioxide, magnesium sulfate, silica, aluminosilicate, and bentonite, and organic synthetic fillers such as polystyrene particles, and urea-formalin resin particles.

Further, various addition auxiliary agents for papermaking such as a pigment, a pH adjusting agent, a slime control agent, an antifoaming agent, and a thickening agent can be used according to purposes.

A wet papermaking machine used in the papermaking step is not particularly limited and a Fourdrinier machine, a cylinder paper machine, an inclination type papermaking machine, a twin wire papermaking machine or the like, which are applied to a general papermaking techniques, can be used. In addition, the radiation shielding sheet of the present invention may be composed of, in addition to single-layer paper thus obtained, multilayer combination paper in which single-layer paper sheets are laminated.

The thickness, basis weight, and strength of the radiation shielding sheet 1 may be appropriately adjusted according to purposes. From the viewpoint of a radiation shielding capacity, the radiation shielding sheet 1 can exhibit suitable performance at a basis weight of approximately 50 to 1000 g/m$^2$.

The content of the radiation shielding material 20 required for the radiation shielding sheet 1 to realize the aforementioned basis weight range is slightly different depending on materials. However, the content of the radiation shielding material is 0.25 or more, preferably 1 or more, and more preferably 4 or more, with respect to 1 by weight of the fiber (a total amount of the main fibers and the auxiliary fibers when the auxiliary fibers are mixed) by weight ratio.

The radiation shielding sheet of the embodiment will be described in more detail using examples.

Example 1

As the fiber 10, needle-leaved tree bleached kraft pulp (NBKP) beaten to a degree of beating of 450 CSF using a beating machine (DDR) was prepared. In addition, as the radiation shielding material 20, tungsten (product name: D-100, manufactured by A.L.M.T. Corp., average particle size (Fischer method): 7.6 to 12 μm) was prepared. The fiber 10 and the radiation shielding material 20 were blended at a ratio of 20 to 80 wt % (hereinafter, also referred to as raw material pulp). Then, 0.5 wt % of a wet paper strengthening agent (product name: WS 4024, manufactured by Seiko PMC Corporation), and 0.5 wt % of a dry paper strengthening agent (product name: DS 4356, manufactured by Seiko PMC Corporation) were blended with respect to a total amount of the raw material pulp to obtain a raw material slurry.

0.005 wt % of a flocculant (product name: Polytention, manufactured by Arakawa Chemical Industries, Ltd.) was added with respect to 100 parts by weight of the solid content of the raw material slurry to prepare an aggregate dispersion. The aggregate dispersion is formed into paper using an inclination type papermaking machine to obtain a radiation shielding sheet having a basis weight of 700 g/m$^2$.

Example 2

Papermaking was performed in the same procedures as in Example 1 to obtain a radiation shielding sheet having a basis weight of 700 g/m$^2$ except that tungsten (product name: WL, manufactured by JAPAN NEW METALS CO., LTD., average particle size (Fischer method): 10.0 to 40.0 μm) was used as the radiation shielding material 20.

The radiation shielding sheets of both examples had a thickness of approximately 300 μm, and various processing such as bending, bonding, and cutting into a predetermined shape was able to be performed easily. Thus, the radiation shielding sheets had excellent workability.

The radiation shielding performance of the radiation shielding sheet of each example will be described.

Test 1 Measurement of X-ray Shielding Performance

A tube current of a bulb tube which generates X-rays was fixed at 200 milliamperes (mA) and a tube voltage was gradually increased from 50 kilovolts (kV) to 150 kV. A distance between the bulb tube and the table was set to 120 cm and a measurement element of a skin dose dosimeter was disposed away from the table surface by 10 cm not to count the number of scattering rays. Further, the measurement element was disposed so as to be perpendicular to a straight line coupling the positive electrode and the negative electrode of the bulb tube so that heel effect does not occur.

An X-ray irradiation time was set to 100 milliseconds (msec), and X-ray irradiation and X-ray measurement were performed three times in the same irradiation filed to adopt the average value. A measurement value in a state in which the radiation shielding material was not present was set as a reference value to calculate a shielding rate with respect to the adopted value.

As the radiation shielding material, the radiation shielding sheets (one radiation shielding sheet, a five-layer laminated radiation shielding sheet, and a ten-layer laminated radiation shielding sheet) of Examples 1 and 2 were used. In addition, thin lead plates (thickness: 0.25 mm, and 1.0 mm) were used in the measurement for comparison.

Figure 2:
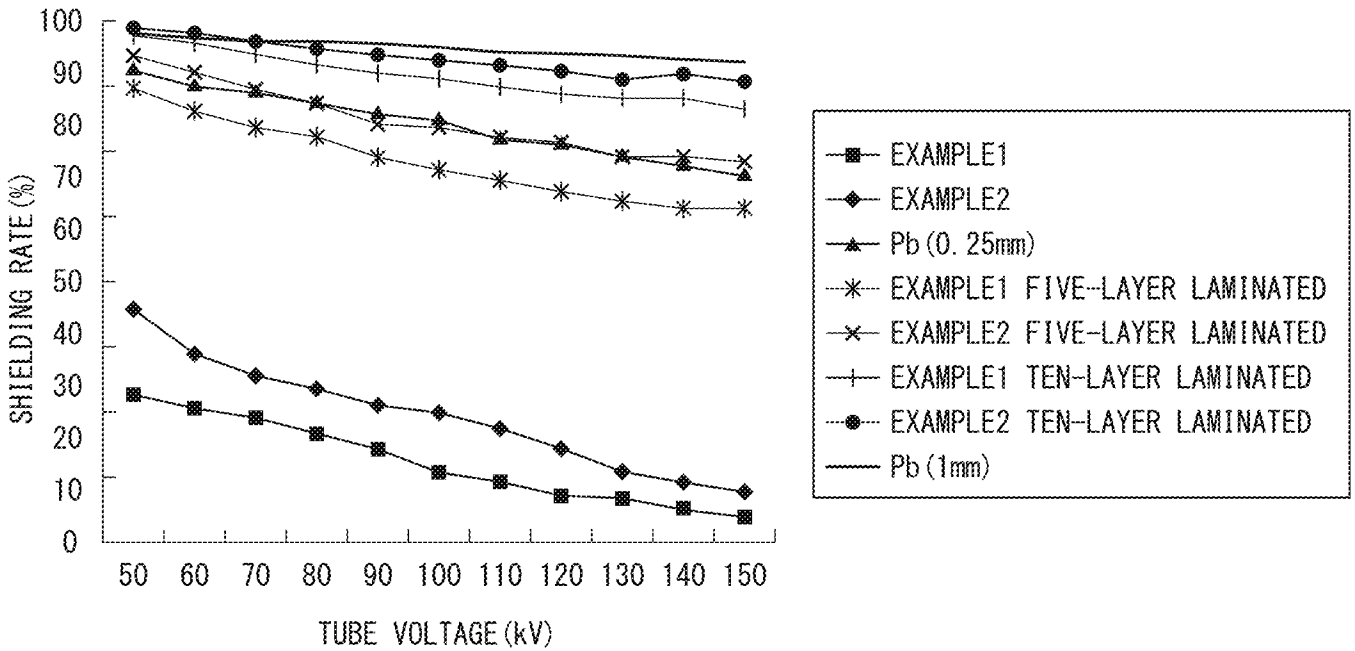
FIG. 2 is a graph showing an X-ray shielding capacity of the radiation shielding sheet.

The results are shown in FIG. 2. In both cases of the radiation shielding sheets in Examples 1 and 2, a certain degree of X-ray shielding performance was exhibited with one radiation shielding sheet, and the performance was enhanced by using the multi-layer laminated radiation shielding sheet. In both Examples 1 and 2, almost the same degree of X-ray shielding performance as in a case of using lead having a thickness of 0.25 mm was exhibited by using the five-layer laminated radiation shielding sheet, and better X-ray shielding performance was exhibited by using the ten-layer laminated radiation shielding sheet, compared to a case of using the lead having a thickness of 0.25 mm.

Test 2 Measurement of γ-ray Shielding Performance)

As a γ-ray source, four types of γ-ray sources shown in FIG. 3 were prepared. A distance between each γ-ray source and a measuring machine was adjusted and the amount of γ-rays was set to 0.27 microsieverts per hour (μSv/h) in a state where the radiation shielding material was not present. The value of 0.27 μSv/h was set in consideration of an exposure dose of a tester in the test.

As the radiation shielding material, the radiation shielding sheets (all ten-layer laminated radiation shielding sheets) of both Examples 1 and 2 were used. In addition, thin lead plates (thickness: 1.0 mm, and 0.5 mm) were used in the measurement for comparison.

The results are shown in FIG. 3. Almost the same degree of γ-ray shielding performance as in a case of using the lead having a thickness of 0.5 mm was exhibited by using the ten-layer laminated radiation shielding sheets in both Examples 1 and 2. Further, the shielding performance was decreased gradually as the main energy of the source was increased. This tendency was the same as a case for the lead.

Test 3 Study by Radiography

The radiation shielding sheet of each example was photographed under the condition of 50 kV and 200 mA for 50 msec using an X-ray imaging device (FCR (trade name)). The obtained image was processed using linear gradation of 1024 shades.

Figure 4A:
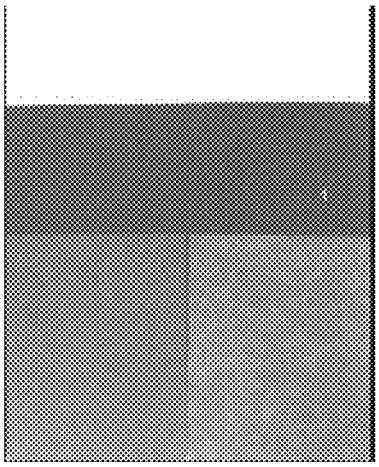
FIG. 4A is an image photographed by irradiating the radiation shielding sheet with X-rays.
Figure 4B:
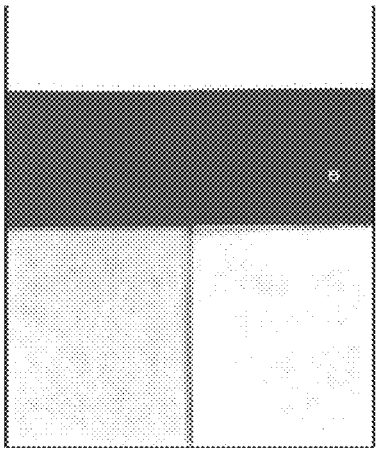
FIG. 4B is an image photographed by irradiating the radiation shielding sheet with X-rays.
Figure 4C:
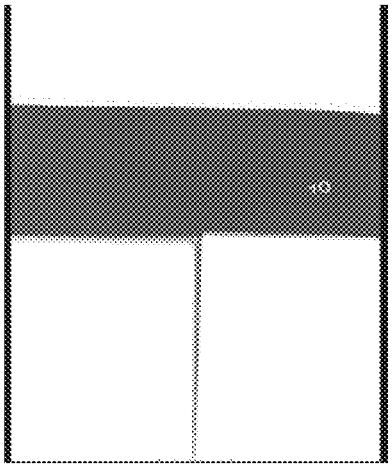
FIG. 4C is an image photographed by irradiating the radiation shielding sheet with X-rays.

FIGS. 4A to 4C show the photographed images. In each image of FIG. 4A, FIG. 4B, and FIG. 4C, an existing protector using lead having a thickness of 0.25 mm was disposed in the upper white region for comparison. In the middle region, an unshielded region is disposed. In the lower region, the radiation shielding sheet of the embodiment is disposed and Example 1 and Example 2 are respectively disposed on the left side and right side. FIG. 4A shows a case where one radiation shielding sheet is used. FIG. 4B shows a case where a five-layer laminated radiation shielding sheet is used. FIG. 4C shows a case where a ten-layer laminated radiation shielding sheet is used.

As shown in FIG. 4A, it was confirmed that a certain degree of X-ray shielding was achieved with one radiation shielding sheet in both examples. However, there was unevenness in X-ray shielding depending on the photographed portions and the obtained image was photographed in patchy. In the cases of the radiation shielding sheets in both examples, X-ray shielding was enhanced by using the multi-layer laminated radiation shielding sheet and the same degree of X-ray shielding was exhibited on the images obtained by the X-ray imaging device as in the case where lead was used, by using the ten-layer laminated radiation shielding sheet. Spot-like unevenness was not observed from the obtained images.

As described above, since the radiation shielding sheet 1 of the embodiment has excellent workability and handling properties, the radiation shielding sheet can be suitably used in a wide range of applications and thus, radiation exposure can be suitably suppressed.

In addition, since the radiation shielding performance can be enhanced by using the multi-layer laminated radiation shielding sheet, it is possible to easily realize a desired radiation shielding performance according to purposes or the like.

Each embodiment of the present invention has been described above. However, the technical range of the present invention is not limited to the above embodiments and each constituent element can be variously changed or removed within a range not departing from the scope of the present invention.

What is claimed is:

1. A radiation shielding paper sheet comprising:

paper formed of a blended material including:

pulp fibers as main fibers to form the paper and respectively having hydrophilic portions, and granular radiation shielding material particles mixed with the pulp fibers, the blended material integrally formed in a sheet shape, wherein an average particle size of the granular radiation shielding material particles is 7.6 to 40 micrometers, a first amount, by weight, of the granular radiation shielding material particles in the radiation shielding paper sheet is larger than a second amount, by weight, of the pulp fibers in the radiation shielding paper sheet, the first amount, by weight, of the granular radiation shielding material particles is a largest amount, by weight, in the radiation shielding paper sheet, the second amount, by weight, of the pulp fibers as the main fibers to form the paper is a second largest amount, by weight, in the radiation shielding paper sheet, a sum of the first amount and the second amount exceeds 99% of the radiation shielding paper sheet by weight, and the granular radiation shielding material particles comprises at least one selected from a tungsten and an oxide of tungsten.

2. The radiation shielding paper sheet according to claim 1, wherein the blended material integrally formed in the sheet shape is by a wet papermaking method.

3. The radiation shielding paper sheet according to claim 2, wherein the pulp fibers were beaten at a degree of beating of 750 CSF to 100 CSF, the blended material was dispersed in water to prepare a slurry, and the slurry was formed into the paper using the wet papermaking method.

4. The radiation shielding paper sheet according to claim 1, wherein the blended material further comprises an auxiliary fiber capable of being melted or softened by heat.

5. The radiation shielding paper sheet according to claim 1, wherein the pulp fibers are at least one selected from:

mechanical pulp selected from ground wood pulp, pressurized ground wood pulp, and thermo-mechanical pulp;

chemical pulp selected from high yield needle-leaved tree kraft pulp, needle-leaved tree bleached kraft pulp, broad-leaved tree unbleached kraft pulp, and broad-leaved tree bleached kraft pulp;

waste paper pulp selected from deinked pulp and waste pulp;

wood pulp as semi-chemical pulp; and a natural fiber selected from cotton, straw, bamboo, esparto, bagasse, linter, manila hemp, flax, hemp, jute, and gampi.

6. A method of manufacturing the radiation shielding paper sheet according to claim 1, the method comprising:

producing the radiation shielding paper sheet by one of a wet papermaking method and a dry papermaking method.

* * * * *